US005190511A

United States Patent [19]

Petree

[11] Patent Number: 5,190,511

[45] Date of Patent: Mar. 2, 1993

[54] EXERCISE EQUIPMENT EMPLOYING FLUID RESISTANCE SUITABLE FOR USE IN SPACECRAFT AND OTHER LOW GRAVITY ENVIRONMENTS

[76] Inventor: Larry G. Petree, P.O. Box 3457, Lubbock, Tex. 79452

[21] Appl. No.: 754,442

[22] Filed: Sep. 3, 1991

[51] Int. Cl.[5] ..... A63B 21/008

[52] U.S. Cl. ..... 482/112; 482/137

[58] Field of Search ..... 482/111, 112, 113, 136, 482/137, 142

[56] References Cited

U.S. PATENT DOCUMENTS

| | | | |
|---|---|---|---|
| 445,726 | 2/1891 | Coop | 482/112 X |
| 3,369,403 | 2/1968 | Carlin et al. | 482/113 |
| 3,495,824 | 2/1970 | Cuinier . | |
| 3,738,661 | 6/1973 | Moller | 482/112 X |
| 3,926,430 | 12/1975 | Good, Jr. | 482/112 |
| 4,171,802 | 10/1979 | Stoecker . | |
| 4,226,415 | 10/1980 | Wright | 482/113 |
| 4,555,108 | 11/1985 | Monteiro . | |
| 4,625,960 | 12/1986 | Groich et al. | 482/113 |
| 4,667,955 | 5/1987 | Giesch | 482/113 |
| 4,801,138 | 1/1989 | Airy et al. | 482/112 |
| 4,801,139 | 1/1989 | Vanhoutte et al. | 482/112 |
| 4,807,877 | 2/1989 | Buxton . | |
| 4,846,460 | 7/1989 | Duke . | |
| 4,854,577 | 8/1989 | Sims . | |
| 4,872,668 | 10/1989 | Mc Gillis et al. | 482/113 |
| 4,880,230 | 11/1989 | Cook | 482/113 |
| 4,884,800 | 12/1989 | Duke . | |
| 4,893,808 | 1/1990 | McIntyre et al. . | |
| 4,979,734 | 12/1990 | Sims | 482/112 |
| 5,052,379 | 10/1991 | Airy et al. | 482/112 X |

FOREIGN PATENT DOCUMENTS

| | | | |
|---|---|---|---|
| 8504935 | 11/1985 | PCT Int'l Appl. | 482/112 |

OTHER PUBLICATIONS

Rotac Fluid Power Rotary Actuators brochure, Ex-Cell-O Corporation, 945 E. Sater St., Greenville, OH 45331.

*Primary Examiner*—Robert Bahr

*Attorney, Agent, or Firm*—Mason, Fenwick & Lawrence

[57] ABSTRACT

A simplified fluid flow resistance device and exercise equipment utilizing the same is disclosed. In a preferred embodiment, a rotating shaft is centered in a fluid filled sealed cylinder. A rotor is connected to the shaft and a baffle is connected to the internal wall of the cylinder. Rotation of the rotor in the cylinder drives fluid through bores in the baffle. Adjustable spring loaded ball valves are situated in at least two bores passing through the baffle so that resistance to fluid flow through the baffle in opposite directions can be controlled. The simplified design of the fluid flow resistance device of the present invention utilizes less materials so as to have minimal weight; thus the fluid resistance device is ideal for use in spacecrafts. Further, by use of spring loaded one way valves, the device can be used in any orientation, and a minimum resistance to motion of a lever arm connected to the fluid resistance device can be obtained.

12 Claims, 3 Drawing Sheets

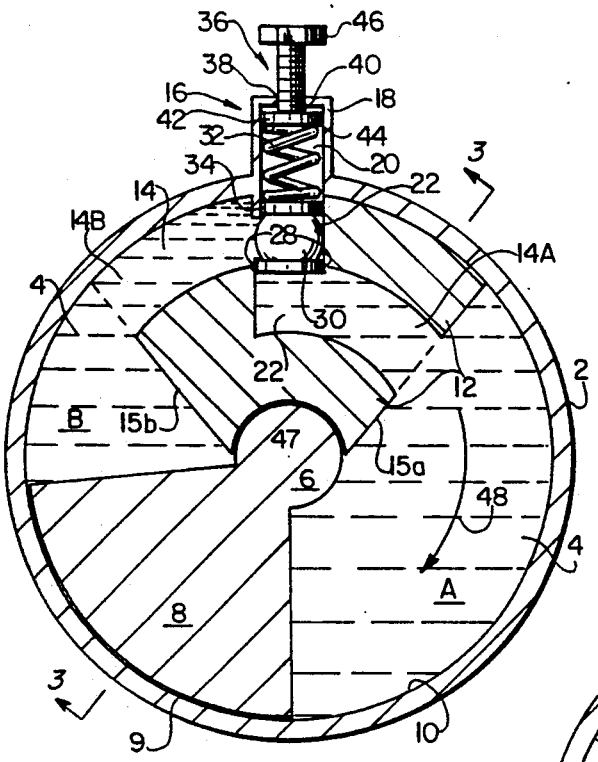
FIG. 1
FIG. 2
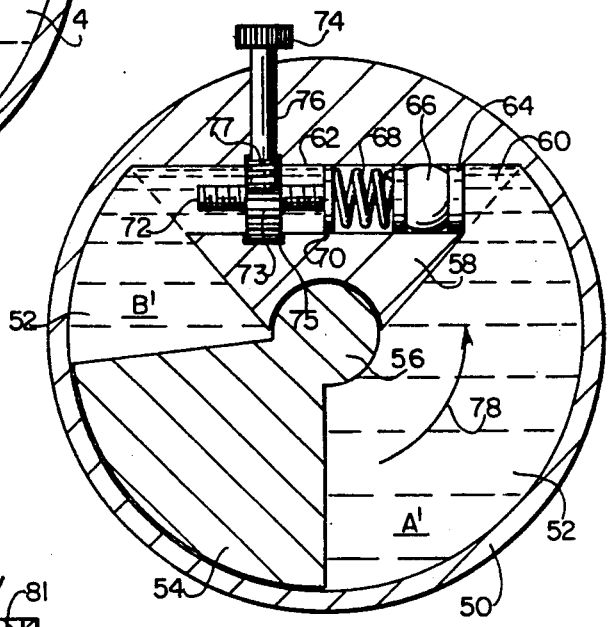
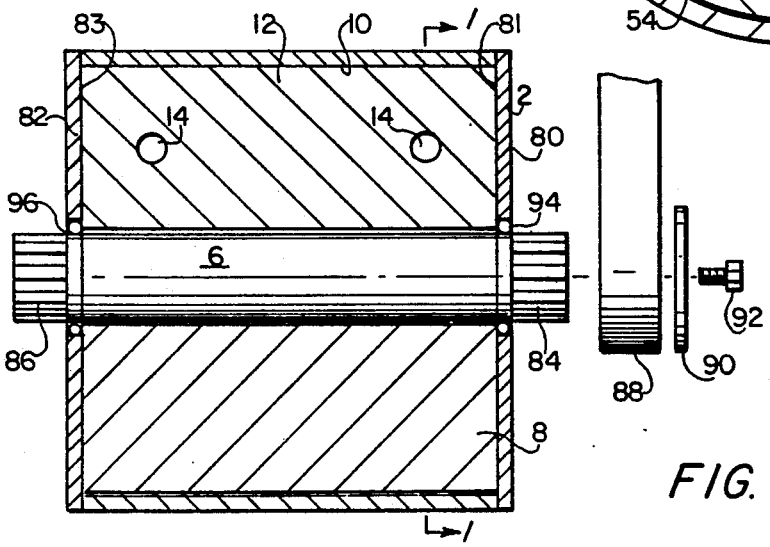
FIG. 3

EXERCISE EQUIPMENT EMPLOYING FLUID RESISTANCE SUITABLE FOR USE IN SPACECRAFT AND OTHER LOW GRAVITY ENVIRONMENTS

FIELD OF THE INVENTION

This invention relates to exercise equipment utilizing fluid resistance, and relates more particularly to exercise equipment having adjustable fluid resistance, the magnitude of which can vary depending on the direction of fluid flow in a fluid resistance device.

BACKGROUND OF THE INVENTION

Exercise devices utilizing fluid resistance devices are known to have numerous advantages over exercise devices utilizing springs or weights. For example, Cuinier, in U.S. Pat. No. 3,495,824, discloses exercise equipment in which resistance to the motion of a lever arm is generated by a fluid resistance device. The fluid resistance device of Cuinier's patent uses, as the force opposing muscular effort, the resistance produced by forcing a liquid through a constriction. Cuinier's fluid resistance device includes a fluid filled cylinder having a shaft centered therein. A lever in Cuinier's device is connected to the shaft in the cylinder, and the shaft is connected to a piston for driving liquid through a constriction. Movement of the piston in either direction forces fluid out of the cylinder and into an external conduit containing a constricting element; by use of a branched conduit system and one way valves, fluid resistance can be varied depending on the direction in which the piston is moved in the cylinder and depending on the fluid flow rate. In order to adjust the resistance to flow, Cuinier's device is provided with adjustable needle valves in the external conduits.

U.S. Pat. No. 4,854,577, to Simms, discloses an exercise machine having a double-acting hydraulic pump in which the resistance to movement in opposite directions can be varied. Simms utilizes a complicated conduit and valve system, which includes two non-return valves as well as two pressure valves having adjustable spring loaded plungers. The patents discussed above, and all other references mentioned herein, are incorporated by reference as if reproduced in full below.

Construction of prior art fluid resistance exercise devices, such as those disclosed in the Cuinier and Simms patents, is complicated due to use of elaborate conduit and valve systems. The inclusion of needle valves, which merely constrict flow through a conduit, allow the user to operate the prior art exercise equipment with minimal effort, thus reducing the benefits of using the exercise device; this is because the amount of resistance will depend on the speed at which the user wishes to move the fluid or operate the user driven lever (or levers) connected to the fluid resistance device. Hence, a consistent exercise program is difficult to accomplish using such a design because the user has no obligation to exert a minimum amount of pressure on each stroke in order to move the fluid from one portion of the device to the other through the constriction valve. In contrast, an athlete attempting to utilize exercise equipment having solid weights or springs must exert a minimum force to lift the weights or extend a spring; failure to exert a sufficient force will prevent the athlete from completing the exercise since the weight or spring will not move. In other words, there is an all or nothing response in conventional exercise equipment utilizing weights or springs which is not duplicated in prior art fluid resistance devices.

In devices, such as that disclosed in the Simms patent, which utilize non-return valves that are dependent on gravity, the device must always be used in an up-right position (i.e., correct operation of the fluid resistance device is orientation dependent). It is especially important that exercise devices to be utilized by astronauts in space not be dependent on their orientation for correct operation due to the low gravitational forces in the spacecraft; hence, conventional exercise equipment utilizing weights is too bulky and heavy to send into space, and would be of no use in a gravity free (weightless) environment. Further, spring operated exercise equipment can be dangerous when used in close proximity to other humans or in small compartments, such as spacecraft compartments.

Thus, there is a need for a simplified fluid resistance device for use in exercise systems, in which resistance to motion in opposite directions can be adjusted, and in which a minimum pressure must be applied in order to induce fluid flow within the device. There is also a need for a fluid resistance device which can operate in an orientation and/or gravity free environment.

Therefore, it is a primary object of the present invention to provide a simplified push pull exercise system utilizing a fluid resistance device, having no external fluid flow conduits.

It is a further object of the present invention to provide an improved simplified push pull exercise system utilizing a fluid flow resistance device having unitary one way flow valves which provide for an adjustable minimum flow resistance.

It is yet another object of the present invention to provide a fluid flow resistance device which can be used in any orientation.

SUMMARY OF THE INVENTION

These and other objects of the present invention are achieved in a preferred embodiment of the present invention by exercise equipment utilizing a simplified fluid flow resistance device. In a first preferred embodiment, a rotating shaft extends through a fluid filled sealed cylinder. A rotor, in the shape of a portion of the cylinder, and substantially filling a space between the central shaft and the cylinder walls, is integrally connected to the central shaft. A baffle, in the form of a portion of a cylinder projection, is connected to at least one interior wall of the cylinder, and projects from the interior cylinder wall to the shaft so as to minimize any fluid which can pass between the shaft and the baffle. A plurality of bores pass through the baffle, and the bores are blocked by one way, adjustable, spring loaded ball valves, otherwise known as back pressure valves, situated therein.

Movement of the rotor in either direction forces fluid into the bores in the baffle. Fluid pressure beneath a ball valve pushes the ball in the valve against a tension spring, and lifts the ball, if the pressure is large enough, to allow fluid to pass through the valve. Fluid pressure against the side or top of the ball in a ball valve will force the ball into a valve seat, and prevent fluid flow through a bore.

In a preferred embodiment, an integral baffle and valve assembly is used having two adjustable one way ball valves. The valves are aligned so that, for a given cylinder alignment, one valve allows fluid flow in a clockwise direction in the cylinder chamber but does not allow counterclockwise flow, while the other valve allows flow in a counterclockwise direction but blocks clockwise flow. By independent adjustment of the valves with an external control knob, the minimum resistance to shaft rotation can be varied depending upon the direction of rotation.

In an alternative embodiment, a bifurcated shaft is used. One portion of the shaft is connected to one of the outer end walls of the cylinder, an outer shaft, while the other portion of the shaft is rotatably mounted within the cylinder and extends through the opposite end wall of the cylinder, an inner shaft. The inner shaft is connected to a rotor inside of the cylinder. By rotation of the axially aligned shaft portions in opposite directions, fluid can be driven through a baffle which rotates with the rotating cylinder in the opposite direction to the direction which the rotor is moving.

BRIEF DESCRIPTION OF THE DRAWINGS

FIG. 1 is a transverse cross-sectional end view of a preferred embodiment of the fluid resistance device of the present invention taken along lines 1—1 of FIG. 3.

FIG. 2 is a cross-sectional end view of an alternative embodiment of the fluid resistance device of the present invention.

FIG. 3 is a longitudinal cross-sectional view taken along lines 3—3 of FIG. 1.

DETAILED DESCRIPTION OF THE PREFERRED EMBODIMENTS

Figure 4:
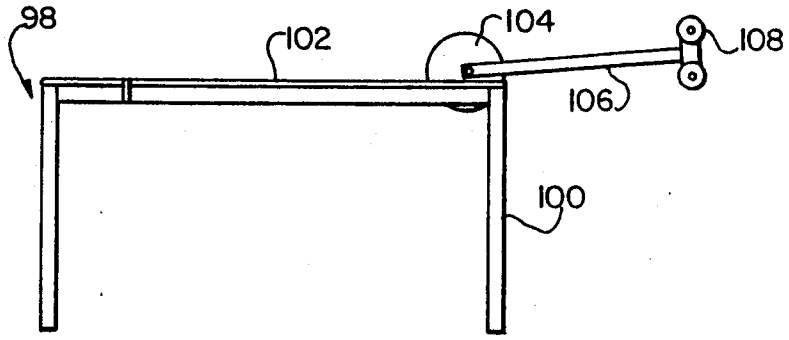
FIG. 4 is a side elevation of the preferred embodiment of an exercise device incorporating either of the fluid resistance devices of the present invention.

With reference to FIG. 1, a transverse cross-sectional view of a preferred embodiment of the fluid resistance device of the present invention is illustrated. In this embodiment, a cylindrical casing 2 has an internal cylindrical inner wall surface 10 which surrounds and defines a cylindrical chamber 4, which is filled with fluid. A cylindrical shaft 6 is coaxially positioned relative to chamber 4 in which it is mounted for rotation. Shaft 6 is integrally connected to a rotor 8. Rotor 8 extends radially outward from shaft 6 to an outer cylindrical surface 9 identical in curvature to and slidably engaging the inner wall 10 of chamber 4. Shaft 6 and rotor 8 can rotate freely in chamber 4. However, surfaces 9 and 10 constitute a sliding seal so that fluid cannot freely pass between these surfaces.

A baffle 12 is fixedly attached to inner chamber wall 10 as best shown in FIG. 1. A plurality of fluid passageways or bores 14, which extend from a first face 15*a* to a second face 15*b* of baffle 12, allow for fluid communication between the chamber portions A and B of chamber 4 on opposite sides of baffle 12. An adjustable pressure responsive check valve 16 (or "one way valve") is located in each passageway 14 in baffle 12 to control fluid movement to and from the chamber portions A and B through baffle 12.

Each of the adjustable pressure responsive check valves 16 preferably comprises a housing 18 which is integrally attached to cylindrical casing 2. Each housing 18 includes cylindrical bores 20, each of which is perpendicular to and terminates in one of the fluid passageways 14 passing through baffle 12.

Fluid passageways 14 comprise two arcuately curved portions 14A and 14B which are shaped to follow the internal shape of casing 2, and are connected by an inner end 22 of radial valve bore 20. A valve seat 28 is situated in inner end 22 of bore 20 between passageway portions 14A and 14B. A ball 30 rests in seat 28, and has sufficient diameter to effectively block fluid flow between passageway portions 14A and 14B when resting in seat 28. A coil compression spring 32 is located in valve bore 20 and urges ball 30 against lower seat 28 through movable upper disk 34.

A threaded pressure screw 36 is threaded through a threaded opening 38 in the top wall 40 of housing 18. The bottom 42 of screw 36 presses against a plate 44 in order to compress spring 32. By turning head 46 of screw 36, the pressure applied through spring 32 to hold ball 30 in seat 28 can be adjusted; thus, the minimum pressure required to enable fluid flow through the valve can be adjusted. Further, since the operation of valves 16 are not dependent on gravity, the device can be used in any orientation.

In a preferred embodiment, there are at least two valves 16 each respectively provided in a passageway 14 in the manner illustrated in FIG. 1. A first one of said valves 16 allows fluid flow from chamber portion B to chamber portion A in a clockwards direction, represented by arrow 48, and a second one of said valves is located in the second bore for allowing counterclockwise flow in a reverse direction from chamber portion A to chamber portion B through baffle 12. As one of skill in the art will readily recognize, the design of bores 14, baffle 12, and of valve 16 can be modified in shape and construction without departing from the essential spirit of the invention, one of the primary aspects of which is to provide for adjustable one way valves in a baffle so as to provide for adjustable fluid resistance in either direction of movement of a user driven lever.

With reference to FIG. 2, an alternative embodiment of the fluid resistance device of the present invention is illustrated. The alternative embodiment in FIG. 2 works in a similar fashion to the first embodiment, and includes a casing 50 forming an internal cylindrical chamber 52, which is filled with fluid and comprises chamber portions $A^1$ and $B^1$. A rotor 54 separates variable volume chamber portions $A^1$ and $B^1$ and is connected to a central shaft 56. Rotor 54 and shaft 56 can rotate freely in chamber 52.

A baffle 58 is integrally connected to casing 50 between chamber portions $A^1$ and $B^1$, and includes a plurality of linear bores 60. Bores 60 pass through baffle 58 so as to provide fluid communication between the chamber portions $A^1$ and $B^1$ in an obvious manner as shown in FIG. 2.

A valve 62 is situated in bore 60, and includes a fixedly positioned annular lower seat 64 for ball 66. A spring 68 is compressed by plate 70 which is driven by screw 72. A control knob 74 can be rotated to turn shaft 76 which is in driven engagement with screw 72 by any conventional means, such as a worm gear 77 fixed to shaft 76 engaging a worm wheel 73 for rotating screw 72, which reacts with threads in fixed surfaces or the like 75 to cause screw 72 to move axially in valve 62, worm wheel 73 being threaded on screw 72 so that rotation of wheel 73 axially moves screw 72. Similarly, screw member 72 could be reciprocated by a rack on the screw member (not shown) driven by a pinion gear (not shown) on shaft 76. By rotating knob 74, screw 72 can be rotated in order to adjust the pressure on ball 66. By increasing the pressure on ball 66, the minimum pressure required for fluid to lift ball 66 from seat 64 can consequently be adjusted.

Rotation of shaft 56 in a counterclockwise direction, as indicated by arrow 78, will move rotor 54 and force fluid in chamber portion $A^1$ against ball 66. Should sufficient fluid pressure be placed against ball 66, ball 66 will overcome the force of spring 68, and lift from seat 64 so that fluid can then pass through bore 60 into the chamber portion $B^1$ of chamber 52. Attempts to rotate shaft 56 and move rotor 54 in a clockwise direction will force ball 66 against seat 64 to create a fluid tight seal, thereby blocking rotation of shaft 56 in a clockwise direction; another check valve identical to valve 62 but reversely oriented relative to chamber portions $A^1$ and $B^1$ will allow fluid flow in the clockwise direction through the baffle from chamber portion $B^1$ to chamber portion $A^1$ when the pressure in chamber portion $B^1$ is sufficient to unseat ball 66 from annular seat 64.

With reference to FIG. 3, a side cross-sectional view of a preferred fluid resistance device of the present invention is illustrated. The cross-section shows baffle 12 to be substantially rectangular in longitudinal cross-section and that baffle 12 is attached to casing 2 at chamber wall 10. Baffle 12 extends from wall 10 to shaft 6, but does not interfere with the rotation of shaft 6 while preventing any substantial fluid flow in the space between shaft 6 and baffle 12. Shaft 6 extends beyond the end walls 80 and 82 of casing 2 so that ends 84 and 86 of shaft 6 project beyond the ends 80 and 82 of casing 2.

Ends 80 and 82 can be attached to casing 2 in a variety of ways; for example one or both of the ends can be welded on, or holes can be located in the edge of casing 2 and around the periphery of ends 80 and 82, and screws can be used to attach the ends. It is also possible to thread the edges of casing 2 and utilize ends 80 and 82 in the form of threaded caps which can be screwed onto the ends of casing 2. Suitable gaskets or sealing materials can be used depending on how ends 80 and 82 are shaped and connected to casing 2.

Note that the ends 84 and 86 of shaft 6 are knurled or are provided with projections and indentations to enable driven engagement with a complimentary opening in one or more lever arms, such as lever arm 88; lever arm 88 can be of any length or configuration. Preferably, a plate or washer 90 and a screw 92 are provided to ensure that lever arm 88 is securely fastened to end 84 of shaft 6. Note that lever arms can be attached to one or both of ends 84 and 86.

Shaft 6 is supported in casing 2 by bearings 94 (not shown in detail) situated in walls 80 and 82 of casing 2. Preferably, bearings 94 are sealed so as to prevent liquid from leaking out of casing 2. Note that baffle 12, contains at least two fluid passageways 14, which are provided with one way valves, such as valve 16. Valves 16 are situated so as to allow for flow in opposite directions. Optional check valves could also be situated in rotor 8, and may include means for preventing excessive pressure in casing 2.

In a preferred embodiment, shaft 6 and rotor 8 are provided with a seal or coating, which prevent leakage of fluid around rotor 8 by sealing between the curved outer surface 9 of rotor 8 and the inner wall 10 of chamber 4, as well as sealing between shaft 6 and the curved inner surface 47 of baffle 12. For example, the outer surface of shaft 6 and the curved face 9 of rotor 8 can be provided with a rubberized gasket, or coated with teflon or another suitable sealing material; likewise, inner wall 10 of chamber 4 can be provided with a similar seal; suitable gasket or sealing materials should allow for easy rotation of shaft 6 and rotor 8 in chamber 4 while still providing a good seal. Further, the inner surfaces 81 and 83 of ends 80 and 82 can also be coated with a gasket material to prevent leakage of fluid between rotor 8 and ends 80 and 82.

It is noted that, when properly constructed, with adequate seals around rotor 8 and shaft 6, that rotation of rotor 8 in chamber 4 will result in compression of air in one portion of chamber 4 and decreased pressure in the portion of chamber 4 on the opposite side of the rotor, and the increased pressure/reduced pressure on opposite sides of ball 30 may be sufficient to unseat ball 30 from seat 28; the pressure differential will increase as one face of rotor 8 approaches one of faces 15*a*, 15*b* of baffle 12. In a preferred embodiment, a more viscous fluid is used, such as, but not limited to, water, hydraulic fluid, light oil, or heavy oil. If water is used, it may be necessary to combine an antifreeze with the water, in case the fluid resistance device is subjected to temperatures beneath 32° F.; it may also be necessary to add appropriate antimicrobial and anticorrosive agents with some of the fluids used to prevent damage to the fluid resistance device. Since many fluids expand and contract with temperature changes, a small head space may be desirable in chamber 4. Thus, in a preferred method for constructing the fluid resistance device, one end of the fluid resistance device, for example end 82, is attached to the casing 2, and the device is oriented with end 82 resting on a flat surface. A liquid is then poured into the chamber 4, until the chamber is almost full, and the second end is then attached.

Figure 5:
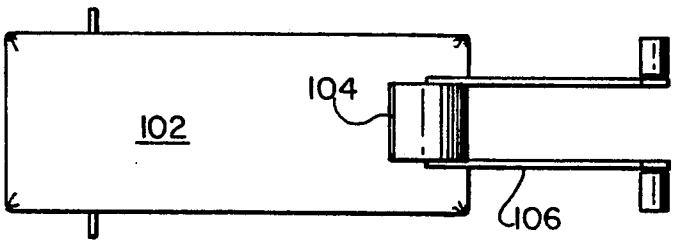
FIG. 5 is a top plan view of exercise equipment incorporating either of the fluid resistance devices of the present invention used in leg exercising.

With reference to FIGS. 4 and 5, new and improved exercise equipment incorporating the simplified and improved fluid resistance device of the present invention is illustrated. The apparatus represented in FIGS. 4 and 5 includes a table 98 having legs 100 and an upper surface 102. A fluid resistance device of the present invention 104 is supported at one end of the table top, and a pair of lever arms 106 are connected to the opposite sides of the shaft projecting out of device 104. Pads 108 are rotatably attached to the ends of arms 106. The fluid resistance device 104 can be attached to table 91 by any one of many possible attachment means; for example, fluid resistance device 104 can be welded or glued to the table, or a portion of the table can be integrally attached to the housing. Further, extensions with mechanical attachment means, such as screws or clasps can be connected onto the housing of device 104 so that it may be easily attached and detached from table 98.

The apparatus in the configuration of FIGS. 4, and 5 can be utilized for leg exercises, in which an individual lying in the prone position on surface 102 inserts the backs of the legs (near the ankles) beneath pads 108; arms 106 can be rotated upward by bending the legs. Resistance to movement of arms 106 can be adjusted by adjusting the tension on the springs in ball valves 16 or 62 in the baffle of device 104. Exercise equipment constructed according to the present invention has many advantages over prior art equipment, such as lower weight, fewer parts, and easier to manufacture. Further, the simplicity of the exercise device helps create an aesthetically pleasing appearance.

Figure 6:
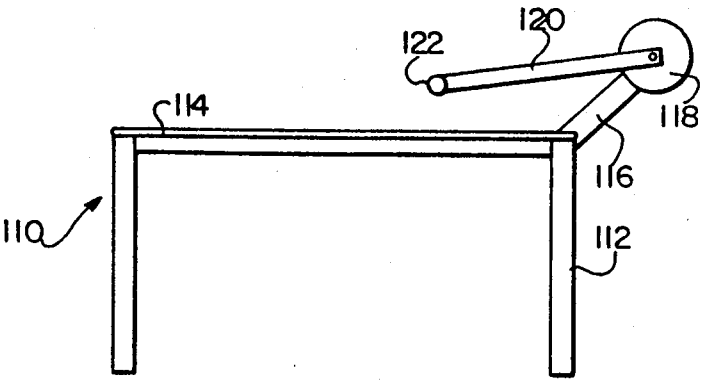
FIG. 6 is a side elevation view of a preferred embodiment of an exercise equipment incorporating either of the fluid resistance devices of the present invention in a bench press configuration.
Figure 7:
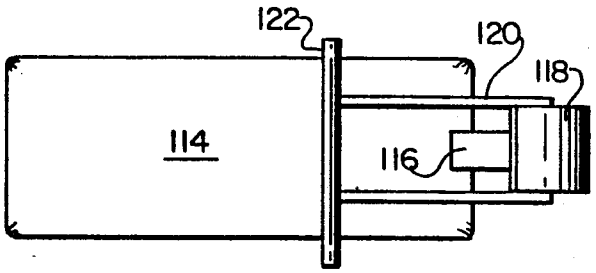
FIG. 7 is a top plan view of a wrist exerciser utilizing an alternative embodiment of the fluid resistance device of the present invention.

With reference to FIGS. 6 and 7, an alternative exercise device is illustrated which incorporates a fluid resistance device of the present invention. The device of FIGS. 6 and 7 is equivalent to a conventional bench press, although it is much simpler in design, and is capable of providing uniform resistance to motion. A table 110 having legs 112 and a top 114 is provided with a support bracket 116 which projects from one end of top 114. Bracket 116 supports a fluid resistance device 118 (which can be of either of the types of FIGS. 1 or 2) constructed according to the teachings of the present invention. A pair of arms 120 are connected to opposite sides of the shaft (such as shaft 16) projecting from fluid resistance device 118, and the opposite ends of both arms 120 are connected to a bar 122.

To utilize the exercise device of FIGS. 6 and 7, a user will position himself on his back on top 114 of table 110 with his shoulders beneath bar 122. By pressing upwards with his hands against bar 122, arms 120 rotate the shaft passing through device 118. Preferably, the valves in device 118 will be adjusted so that upward motion of arms 120 will require greater force than downward motion towards the table top 114.

Depending on the nature of the exercise to be performed, the resistance to motion in opposite directions can be varied, or be equivalent, and the configuration of the exercise equipment can be modified according to the desired muscle group to be developed.

The pieces of exercise equipment illustrated in FIGS. 4–7 all utilize a table. However, in a spacecraft, interior dimensions are limited. Fortunately, any surface in a spacecraft, including the "roof" or "walls", can act as a support for exercise equipment incorporating the fluid resistance device of the present invention. For example, a fluid resistance device constructed according to the present invention can be detachably mounted to a wall of the spacecraft, and the lever arms may be detachable, and even serve as parts of other equipment or tools utilized in the spacecraft. The fluid in the fluid resistance device can also be utilized in other portions of the spacecraft so as to further reduce the additional weight of the spacecraft caused by the inclusion of the exercise device. Further, the simplified construction of the fluid resistance device of the present invention enables less materials to be used, thereby resulting in an additional reduction in the weight of the fluid resistance device of the present invention. Astronauts would benefit by having readily available exercise equipment, which can replace more bulky or heavy devices, thus freeing more room for vital scientific experiments. Thus, the present invention is directed to true space age exercise equipment.

The small size and low weight of the fluid resistance device of the present invention also makes the device ideal for use in aircraft, trains, mobile homes, trucks, trailers, and other limited space areas where people spend long hours.

Figure 10:
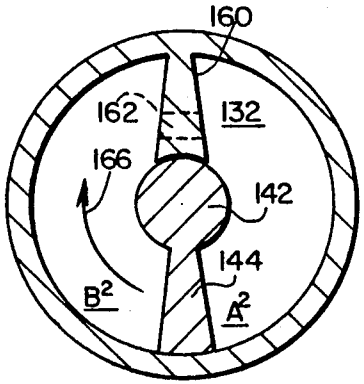
FIG. 10 is a transverse cross-sectional end view taken along lines 10—10 of FIG. 8.
Figure 9:
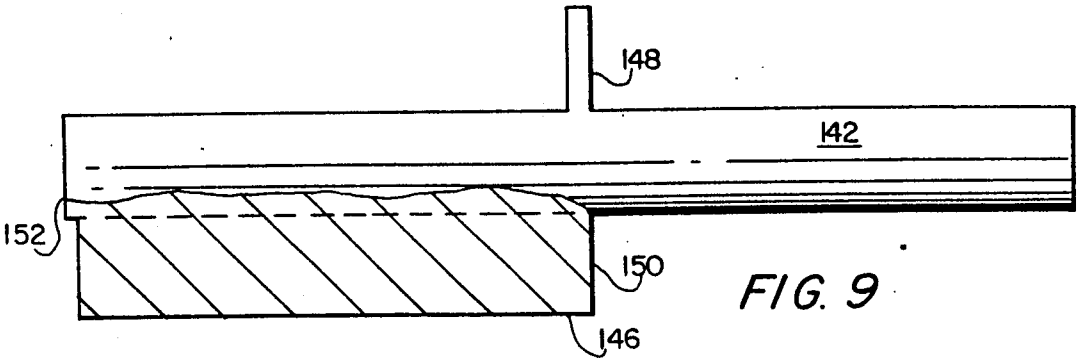
FIG. 9 is a plan view, partially in section, of the shaft and rotor of the embodiment of FIG. 8.
Figure 8:
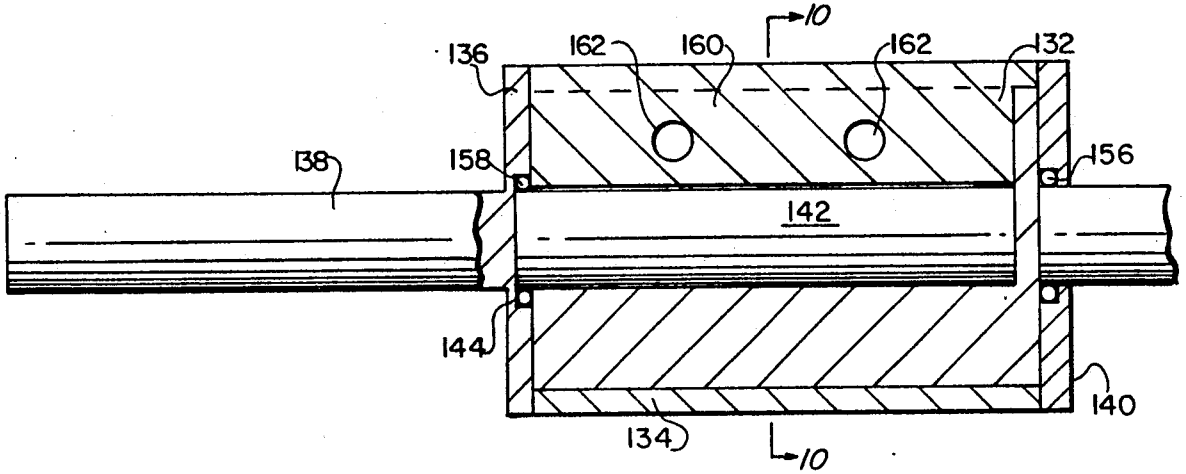
FIG. 8 is a cross-sectional view of another embodiment of the fluid resistance device.

Another alternative embodiment of the fluid resistance device of the present invention is illustrated in FIGS. 8 through 10. With reference to FIGS. 8 and 9, casing 130 forms a cylindrical chamber 132. Casing 130 has a cylindrical wall 134 which connects to a disk shaped end walls 136 and 137. A fixed or external shaft 138 is preferably integrally connected to the center of wall 136, and projects axially outward from casing 130. The outer end of shaft 138 is fixedly connected to frame or other suitable means so that shaft 138 cannot rotate. At the opposite end of cylindrical wall 134 from wall 136 is an end wall 140, which is preferably disk shaped and of the same diameter as cylindrical wall 134. Wall 140 is connected to cylindrical wall 134 so as to seal chamber 132.

A second or inner shaft 142 passes through the center of wall 140 and terminates in a cylindrical recess 144 in wall 136. Shaft 142 is axially aligned with shaft 138.

Shaft 142, best seen in FIG. 9, includes a rotor 146 and an upper plate 148. A cylindrical extension 152 is provided on shaft 142, so that shaft 142 can project beyond rotor 146 into recess 144 in casing 130. Shaft 142, rotor 146, and plate 148 can rotate with respect to casing 130 since shaft 142 is mounted on bearings/seals 156 and 158 located in walls 140 and 136, respectively.

A baffle 160 is connected to wall 134 of casing 130 and extends from wall 134 through chamber 132 to shaft 142. Rotation of shaft 142 with respect to casing 130 will result in fluid in chamber 132 being forced through bores 162 in baffle 160. Preferably, bores 162 are equipped with oppositely oriented one way valves, such as valves 16 illustrated in FIG. 1.

In another embodiment, shaft 138 is not fixedly positioned and grips are provided on shaft 138 and on the portion of shaft 142 extending beyond casing 130 so that shaft 138 and shaft 142 can be simultaneously rotated with respect to one another. In the alternative, shaft 142 can be fixedly attached to a stable support, and opposite shaft 138 rotated; rotation of either shaft 138 or 142 with respect to the other shaft will result in movement of fluid through one or the other of valves such as valves 16 provided in bores 162. It is also contemplated that lever arms can be attached to one or both of shafts 138 and 142.

The valves in bores 162 are adjustable so as to vary the minimum pressure required to rotate shaft 138 with respect to shaft 142. One way valves are located in at least two bores, such as bores 162, so that fluid is permitted through at least one valve in the clockwise direction as indicated by arrow 166, and so fluid may flow from chamber $B^2$ to chamber $A^2$ by passing through baffle 160 through at least one valve in one of bores 162.

In a preferred embodiment, shafts 138 and 142 are one inch in diameter and extend at least five inches beyond end wall 136 and end wall 140. Preferably, chamber 130 is five and one half inches in length and three and one half inches in diameter.

Exercise equipment constructed utilizing the fluid resistance device of the present invention has numerous advantages over the prior art fluid resistance devices; it is easy to construct, and much lighter than prior art fluid resistance devices, which require more elaborate conduit and valve systems. Consequently, the fluid resistance devices of the present invention use much less space and provide for more elegant streamlined exercise equipment constructions. Further, no complicated external conduit or valve systems are necessary due to the improved baffle design which incorporates bores having one way valves therein. Thus, the fluid resistance device fully accomplishes the objects of the present invention. If a constant resistance is desired, the adjustment means on the valves can be dispensed with; further, a solid baffle can be used, and one way valves can be placed in bores in a rotor to provide a device having constant internal resistance to fluid flow.

One of skill in the art will immediately recognize that a variety of materials and configurations can be utilized without departing from the essential spirit and scope of the present invention. Therefore, although preferred embodiments of the present invention have been described, it is understood that the invention can be accomplished other than as specifically described above.

I claim:

1. A fluid resistance device, comprising:

housing means defining a chamber having two variable volume chamber portions for containing fluid;

fluid moving means in said housing means for moving fluid in said housing means from one chamber portion to the other chamber portion;

baffle means in said housing means;

at least two bores passing through said baffle means;

valve means in said baffle means, wherein said valve means and said baffle means cooperate to resist fluid flow between said chamber portions in said housing means;

adjustment means external to said housing means in operative relationship with at least one of said valve means; and lever means external to said housing means in operative relationship with said fluid moving means; wherein:

said valve means comprises at least two one way valves each respectively located in one of said bores, at least one of said valves having a valve element capable of allowing fluid flow through one of said bores in only one direction from a second chamber portion to a first chamber portion, and at least one other of said one way valve means having a valve element being oriented in said other bore to only permit fluid flow in an opposite direction from said first chamber portion to said second chamber portion;

said adjustment means regulates at least one of said valve means to adjust the minimum force required to move said lever in at least one direction so as to cause fluid to flow through at least one of said bores; and said one way valves which will not allow fluid flow in one direction will also not allow fluid flow in the opposite direction unless a predetermined minimum force is applied via said lever means.

2. A device according to claim 1, wherein:

said valves are spring loaded ball valves.

3. A device according to claim 1, wherein:

said housing means is a container having a side wall and first and second end walls, said walls having inner and outer surfaces, wherein said inner surfaces cooperate to form an interior chamber;

said fluid moving means is a rotor connected to a shaft, said shaft passing through said container and extending through and outward from at least one of said end walls;

said rotor comprising first and second side faces, said faces having first and second edges meeting third and fourth edges at an angle, said first edges of said side faces meeting said shaft, said third edges of said side faces being in sliding contact with said inner surface of said first end wall, and said fourth edges of said side faces being in sliding contact with said inner surface of said second end wall, said third and fourth edges on said first and second faces being sufficiently long so that said second edges are in sliding contact with said inner surface of said side wall, said rotor and said shaft capable of rotating in said chamber and said baffle means is a projection connected to at least one of said inner surfaces forming said chamber, said projection having a fourth face and a fifth face, said faces having fifth and sixth edges meeting seventh and eighth edge at an angle, said fifth edges meeting said inner surface of said first end wall said sixth edges meeting said inner surface of said second end wall, said seventh edges meeting said inner surface of said side wall, and said eighth edges being in sliding contact with said shaft, said projection having at least two bores passing from said fourth face through to said fifth face;

wherein fluid in said chamber can be driven through said bores in said projection by moving said rotor, the movement of said rotor in opposite directions being limited by said projection.

4. The device of claim 3, wherein said rotor further comprises an end face; wherein:

said second edge of said first face meets said first edge of said end face and said second edge of said second face meets said second edge of said end face, said end face being in sliding contact with said inner surface said side wall.

5. The device of claim 4, wherein:

said projection has a first bore and a second bore passing through said projection, each said bore having a spring loaded ball valve situated therein, said valves being arranged so that fluid can flow through said first bore only from said fourth face to said fifth face and fluid can flow through said second bore only from said fifth face to said fourth face, each said valve having adjustment means so as to be independently adjustable, wherein the magnitude of resistance to movement of said rotor in opposite directions can be adjusted by adjusting the resistance of said valves to flow of fluid through said valves, such that it can be more difficult to move said rotor in one direction than the opposite direction.

6. The device of claim 5, wherein:

said each said valve in each said bore includes a ball biased by a spring towards a seat, wherein, when said ball is pressed into said seat, fluid can not flow through said valve unless a sufficient fluid pressure is placed on said ball to move said ball from said seat.

7. The device of claim 6, further comprising:

lever means external to said housing means in operative relationship with said rotor; wherein:

said adjustment means adjusts the pressure exerted by said spring on said ball, wherein the amount of resistance to movement of said lever means can be adjusted by said adjustment means.

8. The device of claim 7, wherein said inner surface of said walls cooperate to form a cylindrical chamber, and wherein said shaft passes through the axial center of said cylindrical chamber.

9. The device of claim 8, wherein:

said first and second edges of said side faces of said rotor are perpendicular to said third and fourth edges, said end face is curved so as to conform to the shape of the inner surface of said side wall, said first and second edges having a length about equal to the length of the portion of said shaft in said chamber, wherein said rotor is in the shape of a portion of a cylinder, and said fifth and sixth edges of said fourth face and fifth face of said projection are perpendicular to said seventh and eighth edges, said seventh and eighth edges having a length about equal to the length of the portion of said shaft in said chamber, wherein said projection is in the shape of a portion of a cylinder.

10. The device of claim 9, further comprising:

first sealing means on at least one of said end faces of said rotor, and said inner surfaces of said walls for preventing flow of fluid around said rotor, and second sealing means around said shaft to prevent leakage of fluid from said housing.

11. The device of claim 3, wherein:

said shaft comprises a first portion and a second portion, said portions being axially aligned, wherein said first portion is attached to and extends away from the center of the outer surface of said first end wall, and said second portion is rotationally supported in and passes through the center of said second end wall, said second portion of said shaft having an inner portion and an outer portion, wherein said inner portion extends from said first end wall to said second end wall, and said outer portion extends through said second wall and away from the outer surface of said second wall, said first portion and said second portion of said shaft capable of rotation in opposite directions with respect to each other.

12. The device of claim 11, further comprising:

a cylindrical indentation in said inner surface of said first wall; and wherein:

said inner portion of said first portion of said shaft includes an extension, said extension being rotatably supported in said indentation, and said rotor being attached to said inner portion of said first portion of said shaft.

* * * * *